United States Patent [19]

Roscoe

[11] 3,933,242

[45] Jan. 20, 1976

[54] REED CONTAINER

[76] Inventor: William A. Roscoe, 100 Union St., Erwin, Tenn. 37650

[22] Filed: Nov. 14, 1974

[21] Appl. No.: 523,948

[52] U.S. Cl. ..... 206/314; 206/806; 229/DIG. 14

[51] Int. Cl.[2] ..... B65D 85/54

[58] Field of Search ..... 150/7; 206/244, 260, 271, 206/273–274, 314, 491, 806; 229/53, 56, 72, DIG. 14

[56] References Cited

UNITED STATES PATENTS

| | | | |
|---|---|---|---|
| 607,130 | 7/1898 | Rapp | 206/314 X |
| 1,625,651 | 4/1927 | Gretsch | 206/314 X |
| 2,197,565 | 4/1940 | Brand | 206/314 |
| 2,937,740 | 5/1960 | Bruckmann | 206/314 |
| 3,136,409 | 6/1964 | Schumann | 206/806 X |
| 3,412,771 | 11/1968 | Ralph | 150/7 |

*Primary Examiner*—William Price
*Assistant Examiner*—Steven E. Lipman
*Attorney, Agent, or Firm*—Sughrue, Rothwell, Mion, Zinn & Macpeak

[57] ABSTRACT

The reed container is especially adapted for original packaging and subsequent storage of double reeds for musical instruments and is comprised of a rectangular shaped flexible plastic material doubled back and secured to itself along opposite edges at two locations spaced from the fold line. The plastic sheet is folded back a distance sufficient to prevent the ends of the reed from contacting the fold portion when the reed is inserted between the two sides of plastic sheeting perpendicular to the fold line with the mounting portion thereof resting on the edge of the folded plastic sheet. The fold of the plastic sheet is not creased to provide ventilation gaps adjacent the fold line.

4 Claims, 3 Drawing Figures

REED CONTAINER

BACKGROUND OF THE INVENTION

The present invention is directed to an original display and subsequent storage container for double reeds for musical instruments.

For years double reeds have been packaged in plastic boxes having a hinged cover and latch mechanism so that the reed was maintained in a completely enclosed environment. Such a container however utilized a considerable amount of plastic thereby substantially increasing the packaging cost and the closed environment often led to a mildew problem if a wet reed was stored in the container subsequent to usage.

The container of the present invention overcomes all of the aforementioned shortcomings and provides an extremely attractive and economical display device for original sale as well as an extremely efficient container for subsequent storage which will not only protect the reed during storage but will provide adequate ventilation to prevent the formation of mildew.

SUMMARY OF THE INVENTION

The reed container according to the present invention is comprised of a rectangular sheet of relatively thin plastic material which is folded back upon itself along a non-creased fold line and secured to itself along the edges thereof at a point spaced from the fold line. The sheet is folded back a sufficient distance so that upon engagement of the edge of the sheet by the cork tip of a reed inserted therein the end of the reed will be spaced from the folded portion of the sheet to prevent damage to the end of the reed. Since the fold is not creased two ventilation openings will be provided adjacent the fold portion and the insertion of a reed into the container will provide an additional ventilation opening at the folded back edge of the sheet.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
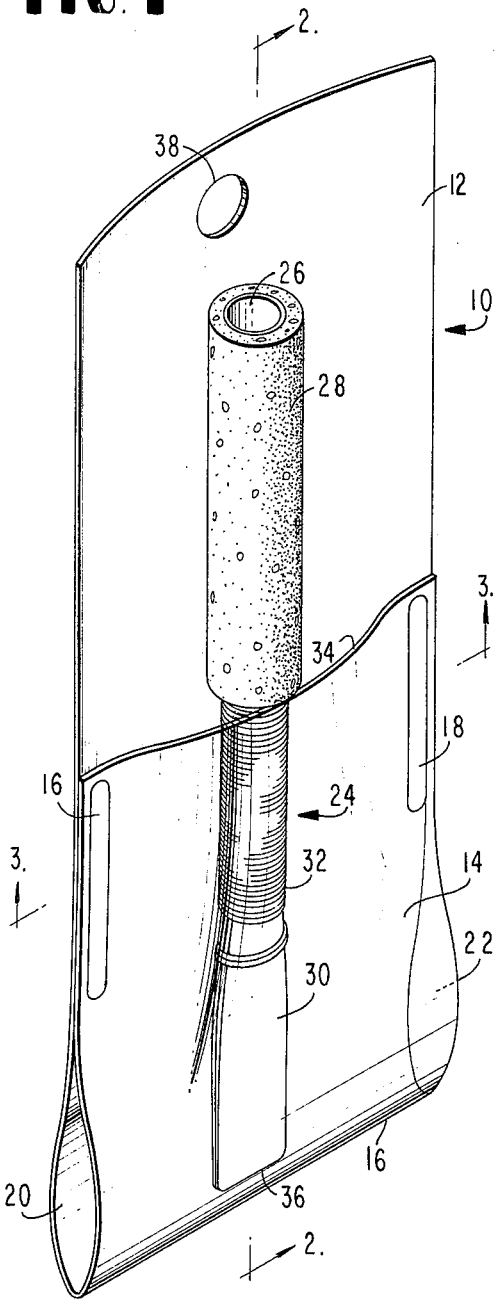
FIG. 1 is a perspective view of the container with a reed held therein.
Figure 2:
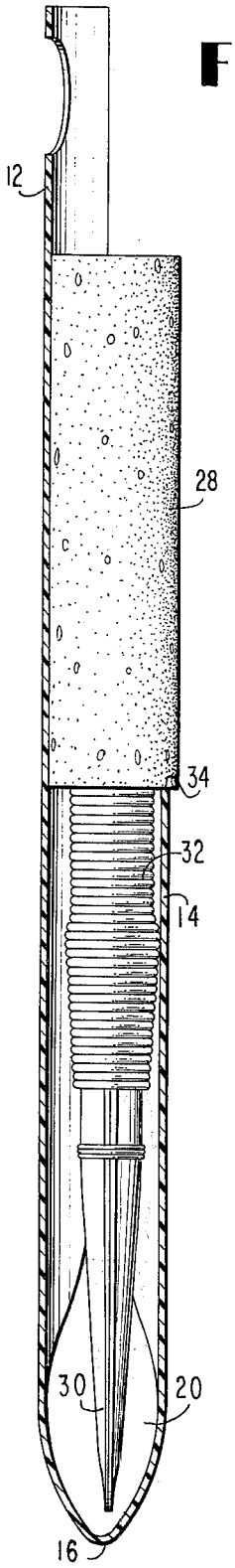
FIG. 2 is a sectional view of the container taken along the line 2—2 of FIG. 1 and showing the reed therein in side elevation.
Figure 3:
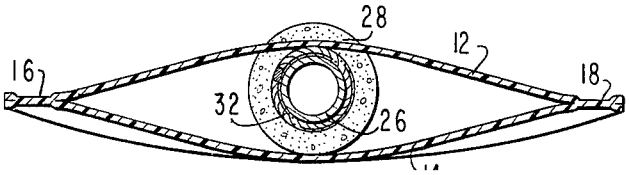
FIG. 3 is a sectional view taken along the line 3—3 of FIG. 1.

The container 10 is comprised of a relatively thin flexible sheet 12 of plastic material. The sheet 12 is substantially rectangular in its initial form and may be transparent, colored, embossed or decorated in any suitable manner. One end 14 of the sheet is folded back upon itself along a fold line 16 which is not creased so that upon securement of the end portion 14 to the main portion of the sheet 12 by heat seals 16 and 18 the sides of the container adjacent the fold line will bow outwardly to form ventilation gaps 20 and 22.

The distance that the end 14 is folded back upon the sheet 12 is determined by the length of the reed to be packaged or stored therein. As shown in the drawings of the present application the double reed 24 is comprised of a metallic cylindrical mandrel 26 having a cylindrical cork tip 28 on one end thereof adapted to be inserted into the musical instrument. The double reed 30 is secured to the opposite end of the mandrel 26 by means of a thread or cord 32 wrapped about the mandrel. The edge 34 of the flap 14 is spaced from the fold line 16 a sufficient distance so that when the end of the cork tip 28 rests on the edge 34 the end 36 of the reed 30 will be spaced from the folded portion of the plastic sheet to prevent damage to the end of the reed. The inherent resiliency of the plastic material will maintain the ventilation gaps 20 and 22 as well as provide the necessary friction between the flap 14 and the main sheet 12 to hold the reed securely in the position shown in the drawings.

The portion of the sheet 12 extending above the edge 34 of the flap 14 is provided with an aperture for hanging the container on a suitable display rack. Suitable advertising in addition may be placed at any suitable location on the plastic sheet 12. The plastic sheet 12 can be of any desired thickness which will provide a suitable degree of stability and flexibility. As an example a sheet of vinyl having a thickness of approximately 6 mm has been found to be satisfactory for the purpose. However, it is obvious that other materials and other thicknesses could be used without departing from the spirit of the present invention. Likewise, although heat sealings 16 and 18 have been illustrated in the present embodiment, it is obvious that the sides of the container could be secured together by any other suitable means such as mechanical clips, adhesive means or the like. Whatever fastening means are used, it is absolutely necessary that they be spaced a sufficient distance from the fold line 16 to allow the plastic to bow outwardly adjacent the fold line 5 for the necessary ventilation to prevent the formation of mildew after the reed is wet from usage.

While the invention has been particularly shown and described with reference to a preferred embodiment thereof it will be undertood by those in the art that various changes in form and details may be made therein without departing from the spirit and scope of the invention.

What is claimed is:

1. A reed container for double reeds having an enlarged shoulder portion spaced from the tip of the reed comprising a flexible, substantially rectangular sheet of plastic material folded partially back upon itself and fastening means securing said folded back portion to said sheet along the edges thereof in spaced relation to the fold portion to provide ventilation gaps adjacent said fold portion, the edge of said folded back portion between said fastening means being spaced from the fold portion a sufficient distance to prevent the tip of a double reed from contacting the fold portion when a double reed is inserted between said sheet and said folded back portion with the shoulder portion of the double reed resting on said edge.

2. A reed container as set forth in claim 1 wherein said fastening means are comprised of heat seals.

3. A reed container as set forth in claim 1 wherein said plastic is transparent.

4. A reed container as set forth in claim 1 and further comprising hanger means disposed adjacent the edge of said sheet remote from said fold portion.

* * * * *